United States Patent [19]

Jones

[11] 4,019,443

[45] Apr. 26, 1977

[54] TABLE

[76] Inventor: Ferris E. Jones, 943 Millbury Ave., La Puente, Calif. 91746

[22] Filed: Feb. 12, 1975

[21] Appl. No.: 549,136

Related U.S. Application Data

[63] Continuation-in-part of Ser. No. 365,438, May 31, 1973, abandoned.

[52] U.S. Cl. ..... 108/137; 108/90; 108/151; 248/424

[51] Int. Cl.[2] ..... A47B 13/00

[58] Field of Search ..... 108/137, 90, 102, 143, 108/151; 248/424, 429

[56] References Cited

UNITED STATES PATENTS

| | | | |
|---|---|---|---|
| 796,855 | 8/1905 | Nurick | 108/90 |
| 1,174,374 | 3/1916 | Zotz et al. | 292/136 |
| 1,413,111 | 4/1922 | Fricker | 108/90 |
| 1,886,806 | 11/1932 | Hanley | 108/90 |
| 1,904,897 | 4/1933 | Kahrs | 108/90 |
| 2,175,572 | 10/1939 | Ruhl | 108/90 |
| 2,468,962 | 5/1949 | Czak | 108/90 |
| 2,723,891 | 11/1955 | Draxler | 108/137 |
| 2,837,390 | 6/1958 | Von der Hellen | 108/137 |

*Primary Examiner*—Roy D. Frazier
*Assistant Examiner*—Darrell Marquette
*Attorney, Agent, or Firm*—Boniard I. Brown

[57] ABSTRACT

A table having a sliding table top supported on a base for edgewise adjustment of the top relative to the base, and means for releasably locking the top in fixed position relative to the base. The table is designed for use in combination with a bench seat or the like to provide a dining facility, such as a breakfast nook, wherein the table top may be moved away from the seat for convenience of access to and egress from the seat and toward the seat to a comfortable dining position.

9 Claims, 15 Drawing Figures

FIG. 11.
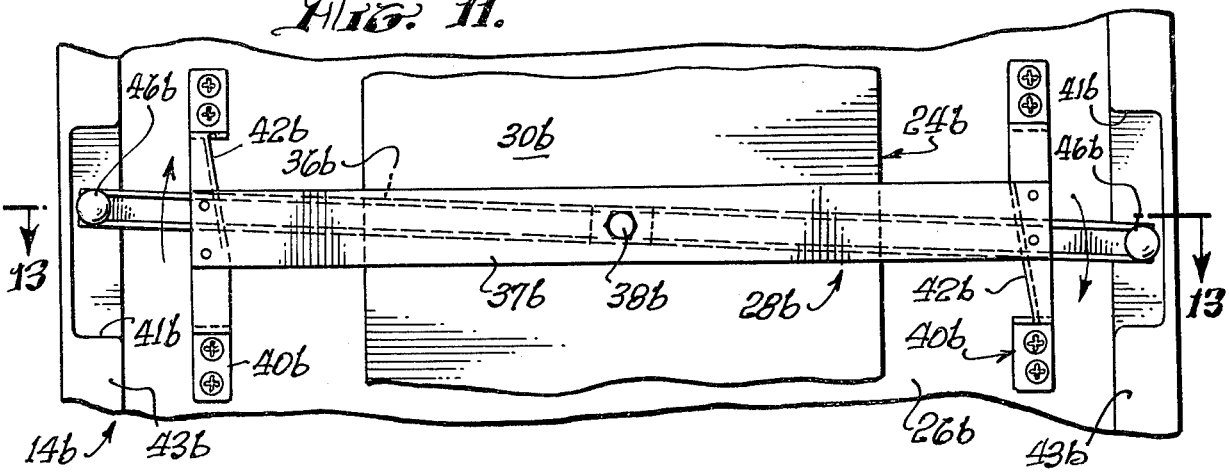
FIG. 12.
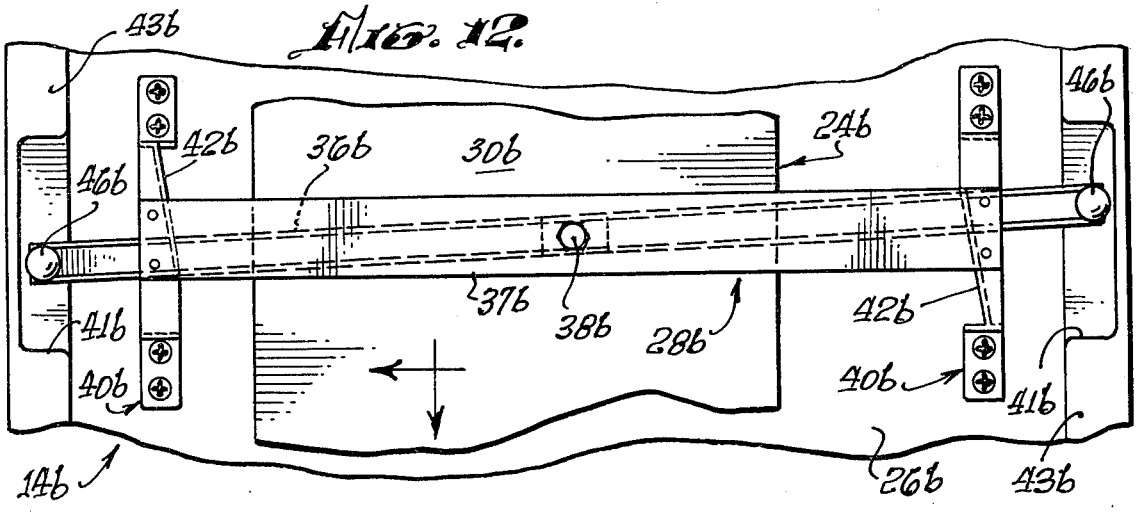
FIG. 13.
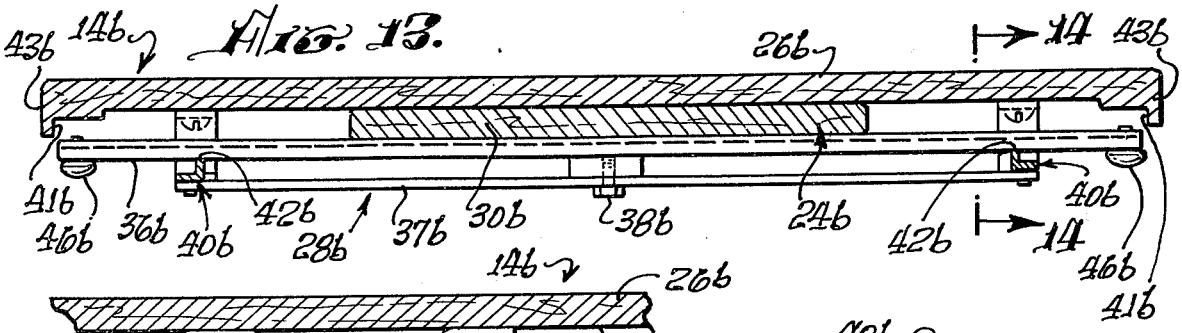
FIG. 14.
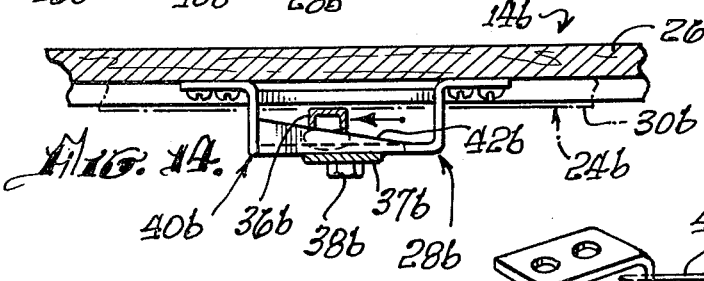
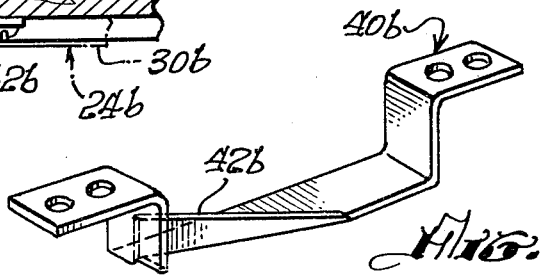
FIG. 15.

TABLE

RELATED APPLICATIONS

This application is a continuation-in-part of application Ser. No. 365,438, filed May 31, 1973, now abandoned. Reference is also made to my co-pending application Ser. No. 546,204 filed Feb. 3, 1975, entitled Furniture Combination, which is a continuation-in-part of Ser. No. 488,909.

BACKGROUND OF THE INVENTION

1. Field of the Invention

This invention relates generally to furniture and more particularly to a table with an adjustable top which may be locked in adjusted position.

2. Prior Art

As will appear from the ensuing description, this invention is concerned with an adjustable table structure per se. However, the table is intended for use in combination with a bench seat or the like to provide a dining facility such as a breakfast nook. Accordingly, it is worthwhile to consider the table in connection with this use.

A typical dining facility of the character described has a bench seat which may be upholstered and have any one of a variety of shapes, such as straight, L-shaped, or generally semi-circular. Located in front of the seat is a table having a base and table top supported on the base. The table is commonly mounted in a fixed position relative to the seat, although my earlier mentioned co-pending application Ser. No. 281,322 discloses a dining facility of this type in which the table is hinged to the seat to permit elevation of the table above the floor for convenience of cleaning under the table.

Dining facilities of this kind present one problem to which the present invention is addressed. The problem referred to resides in the fact that ease of access to and egress from the seat requires a relatively large spacing between the seat and table top. This spacing, on the other hand, is too great for comfortable dining. Tables having fixed tops are thus ill-suited for use in such dining facilities. A fixed table top is also undesirable from the standpoint that it is not adjustable to the most comfortable dining position for persons of different sizes and ages.

For these reasons, some dining facilities of the class described have tables with adjustable tops which may be moved away from the seat for ease of access to and egress from the seat, and toward the seat to the most comfortable dining position. The existing tables of this type of which I am aware, however, lack any locking means for securing the table top in adjusted position. As a consequence, there exists the hazard that the top may be inadvertently shifted by the diners, resulting in spilled drinks or food. Many such tables are also adjustable in only one direction and hence are not ideally suited for use with other than straight bench seats.

SUMMARY OF THE INVENTION

This invention provides an improved slide top table for the purpose described having a table top which is not only adjustable in all edgewise directions but may also be locked in adjusted position. To this end, the table has a base which supports the table top for edgewise adjustment in all directions, and an easily accessible and operable locking means for securing the top in adjusted position.

In the particular tables described, the base mounts a fixed upper horizontal platform which supports the table top with the under surface of the top resting slidably on the platform. Extending across the underside of the platform, in sliding contact with the platform, are retaining members whose ends are secured to the underside of the table beyond the platform edges. The table top is thus adjustable edgewise relative to the platform, and hence the table base, but is retained in sliding contact with the platform.

The locking means of certain described tables comprises a clamping bar which also extends across the underside of the base platform and is movable to effect releasible clamping engagement of the bar with the platform. Bar retaining means are provided for releasibly retaining the bar in clamping position. The particular retaining means described comprise inclined ramp means along which the clamping bar is movable with a swinging motion generally parallel to the platform to move the bar into and from clamping engagement with the platform.

The locking means of another described table is a pivoted latch member which is engagable with one edge of the base platform to lock the table top against movement in one direction. The latch member is biassed, as by gravity, to latching position.

BRIEF DESCRIPTION OF THE DRAWINGS

FIG. 11 is an enlarged view taken on line 11—11 in FIG. 8 showing the table top locking means in locked position;

FIG. 12 is a view similar to FIG. 11 showing the locking means in unlocked position;

FIG. 13 is a section taken on line 13—13 in FIG. 11;

FIG. 14 is a section taken on line 14—14 in FIG. 13; and

FIG. 15 is an enlarged perspective view of a lock bar camming ramp bracket used in the table of FIG. 8.

DESCRIPTION OF THE PREFERRED EMBODIMENT

Figure 1:
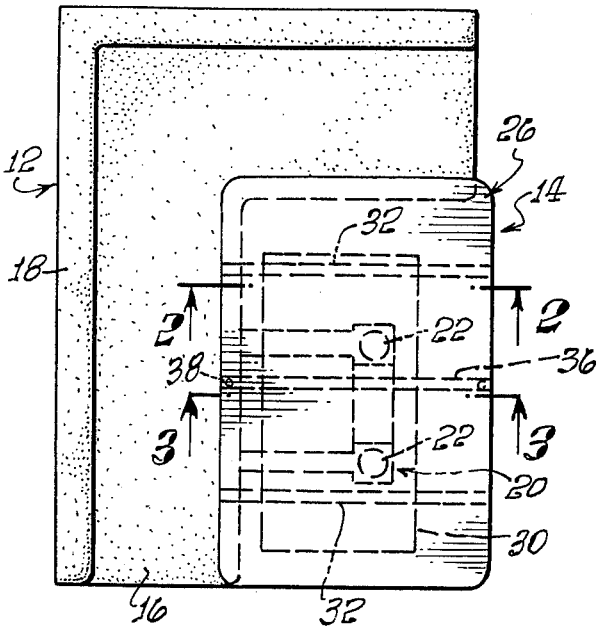
FIG. 1 is a top view of a dining facility or nook embodying an adjustable table according to this invention.

The dining facility or nook 10 in FIG. 1 has an L-shaped bench seat 12 and an adjustable slide top table 14 according to this invention. The bench seat 12 has an upholstered seat cushion 16 and back rest 18. Table 14 is located in front of the seat so to be usably by persons sitting on both portions of the seat.

The particular nook shown in similar to that described in my earlier mentioned co-pending application Ser. No. 281,322, in that the table 14 is hinged to the seat 12 for vertical swinging movement. As described in that application, the table normally rests on the floor but may be elevated above the floor for ease of cleaning below the table. However, this hinged table feature does not form part of this invention, nor is the invention limited to use in connection with such a hinged table construction. Accordingly, it is unnecessary to elaborate further on the hinged construction of the table.

Suffice it to say that the table 14 has a base 20 including two vertical supporting columns 22. Mounted on the base for edgewise movement, by mounting means 24, is a rectangular table top 26 fixed atop a frame 27. Locking means 28 are provided for releasably locking the table top in adjusted position. As will appear from the following description, the top is adjustable in all edgewise directions, such that it may be adjusted toward and away from either or both right angle sections of the bench seat 12.

The table top mounting means 24 comprises a horizontal platform 30 fixed to the upper end of the base 20. The underside of the table top 26 rests slidably on this platform. Extending across the underside of the platform 30 are a pair of retaining members or bars 32. The ends of these retaining bars extends beyond opposite edges of the platform 30 and are secured at their ends to shoulder members 34 of the table top frame 27 which extend along the edges of the top 26 at the underside of the top. The retaining bars slidably engage the underside of the platform 30 and retain the table top in sliding contact with the platform while permitting movement of the top in all edgewise directions relative to the platform.

Figure 3:
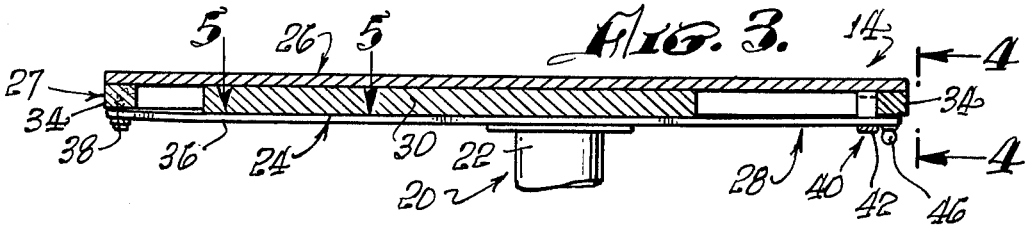
FIG. 3 is an enlarged section taken on line 3—3 in FIG. 1.

The table top locking means 28 comprises a strap-like clamping bar 36 which also extends across the underside of the base platform 30 between and generally parallel to the retaining channels 32. The left end of the bar in FIG. 3 is secured by a pivot 38 to the left table top frame member 34, such that the right end of the bar can swing back and forth in a plane generally parallel to the platform. The clamping bar is flexible such that it can also move up and down into and from clamping engagement with the underside of the platform.

Figure 4:
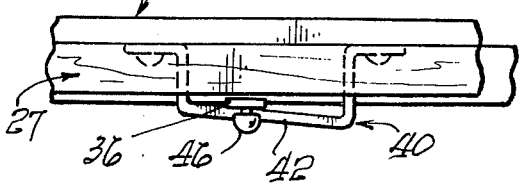
FIG. 4 is an enlarged view looking in the direction of arrows 4—4 in FIG. 3.

A retaining means 40 is secured to the underside of the table top 26 for releasibly retaining the clamping bar 36 in its clamping position. This retaining means comprises a U-shaped ramp bracket havving a lower inclined ramp portion 42 along which the right end of the clamping bar in FIG. 3 is slidable by swinging the bar in its pivot 38. Movement of the clamping bar to the high left hand end of this ramp portion in FIG. 4 urges the bar upwardly to clamping engagement with the platform 30 to lock the table top 26 in adjusted position. A strip 44 of abrasive material may be bonded to the upper surface of the clamping bar to improve its clamping action and retain the bar in clamping position. Movement of the clamping bar to the low right end of the ramp portion releases the table top for adjustment. The clamp bar has a knob 46 to facilitate swinging of the bar between its clamping and released positions.

It will now be understood that the table top 26 is adjustable toward and away from either or both right angle sections of the bench 12 and may be locked in any adjusted position. Thus, the top may be retracted away from the seat to provide easy access to and egress from the seat and adjusted toward the seat to the most comfortable dining position for persons seated on both sections. The top is locked in its adjusted position to prevent its accidental movement by the diners.

Figure 5:
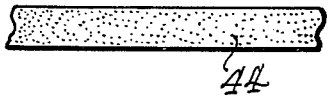
FIG. 5 is an enlarged view taken on line 5—5 in FIG. 3.
Figure 2:
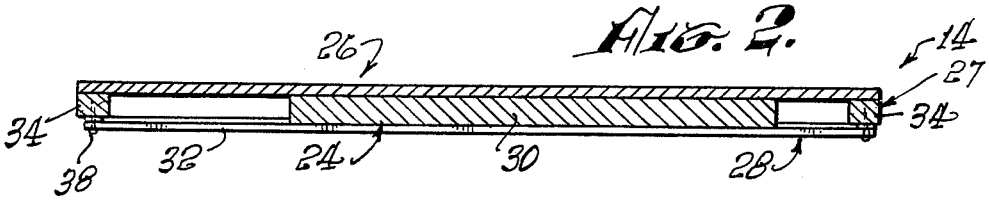
FIG. 2 is an enlarged section taken on line 2—2 in FIG. 1.
Figure 6:
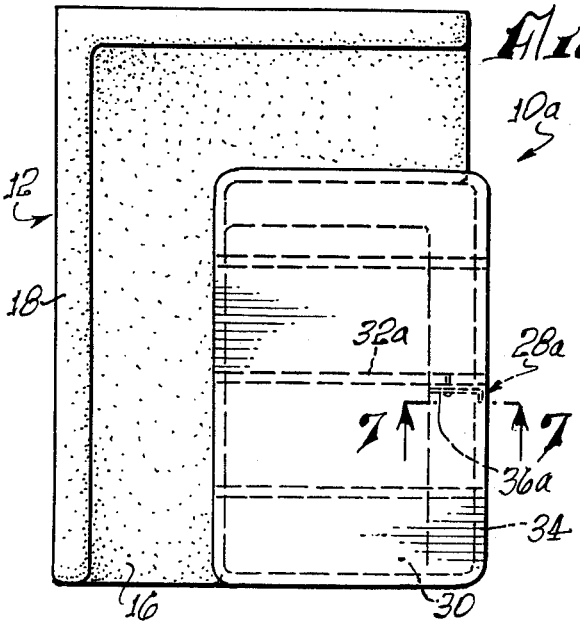
FIG. 6 is a top view of a dining facility or nook embodying a modified adjustable table according to the invention.
Figure 7:
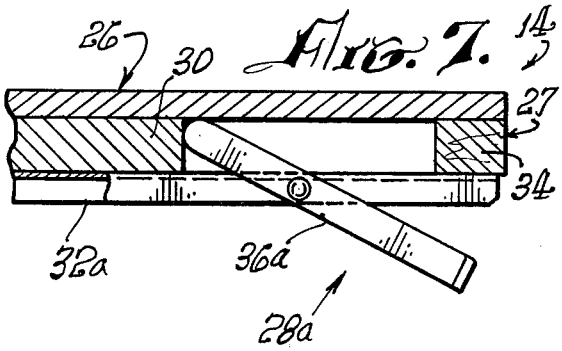
FIG. 7 is an enlarged section taken on line 7—7 in FIG. 6.

FIGS. 6 and 7 illustrate a dining nook **10*a* embodying a modified slide top table 10*a* according to the invention. Table 10*a* is similar to that of FIGS. 1–5 except for the table locking means 28*a*. This table locking means comprises a third retaining member or channel 32*a* which extends across the underside of the base platform 30 and is secured at its ends to the table top frame members 34. Pivoted on this channel is latch member 36*a* which is movable to its latching position of FIG. 7 wherein one end of the member engages an edge of the platform 30 and the opposite edge of the platform engages the depending shoulder 34 along the adjacent table top 26** to positively lock the top against movement. The opposite end of latch member is weighted to bias the latch member to its latching position. The latch is released to permit adjustment of the table top by raising the lower weight end of the latch member.

Turning now to FIGS. 8–15, there is illustrated a dining nook **10*b* embodying a modified slide top table 14*b* according to the invention. Nook 10*b* has an L-shaped bench seat 12*b* with seat and back rest cushions 16*b*, 18*b* supported on a base 19*b*. Table 14*b* is located in front of the seat and is hingably supported on the seat base 19*b*, in the manner explained later, for swinging between its full and broken line positions of FIG. 8. The full line positions illustrate the normal position of use of the table wherein the latter rests on the floor. The broken line positions illustrate an elevated cleaning position of the table, wherein the latter is raised off the floor to permit cleaning below the table. As mentioned in connection with FIGS. 1–5, while the table is illustrated as being hinged, the hinged construction of the table constitutes the subject matter of co-pending application (No. 281,322) and not part of the present invention, which is concerned only with the slide top construction, of the table 14*b*.**

Table **14*b* has a base 20*b* including two vertical supporting columns 22*b*. Atop the base 20*b* are mounting means 24*b* for a table top 26*b*. The top is adjustable edgewise and locked in adjusted position by locking means 28*b*. The table top mounting means 24*b* comprises a horizontal platform 30*b* fixed to the upper ends of the table base columns 22*b*. The underside of the table top 26*b* rests slidably on the platform 30*b*,** such that the top is slidably adjustable in all edgewise directions.

Table locking means **28*b* comprises a clamping bar 36*b* extending across the underside and beyond opposite edges of the base platform 30*b*. Below the extending lengthwise of the clamping bar 36*b* is a support bar 37*b* to which the clamping bar is attached at its center by a pivot 38*b*. The ends of the support bar extend beyond the edges of the table base platform 30*b* and are attached to clamp bar ramp brackets 40*b* which are firmly secured to the underside of the table top 26*b* beyond the platform edges. The clamping bar ends extend through the brackets 40*b* and beyond the ends of the support bar 37*b* into recesses 41*b* in a shoulder 43*b* depending from the underside of the table top about the edge. The clamping bar is thus pivotally mounted on the table top to swing in a plane parallel to the top of the platform 30*b*.**

Referring to FIG. 5, each ramp bracket 40*b* is a generally U-shaped bracket having a horizontal portion, a generally triangular section of which is bent up to form an inclined ramp 42*b*. As noted above, the ends of the clamping bar 36*b* extend through the ramp brackets. These clamping bar ends are slidable back and forth along the bracket ramps 42*b* by swinging movement of the clamping bar about its center pivot 38*b*. Movement of the clamping bar ends toward the high ends of the ramps 42*b* deflects the bar ends upwardly into clamping engagement with the underside of the base platform 30*b* to lock the table top 26*b* in fixed position relative to the platform and hence also the table base 20*b*. Movement of the clamping bar ends to the low ends of the ramps releases the table top for edgewise adjustment relative to the platform. Fixed to the ends of the clamping bar are knobs 46*b* which may be grasped to swing the clamping bar between its clamping and released or top adjustment positions.

It will now be understood, therefore, that the table top 26*b* may be adjusted edgewise in any direction by releasing the clamping bar 36*b* and then locked in adjusted position by swinging the clamping bar to its clamping position. The bar is accessible at both the rear or inner and front or outer edges of the table top for movement of the bar to lock and release the top.

Figure 8:
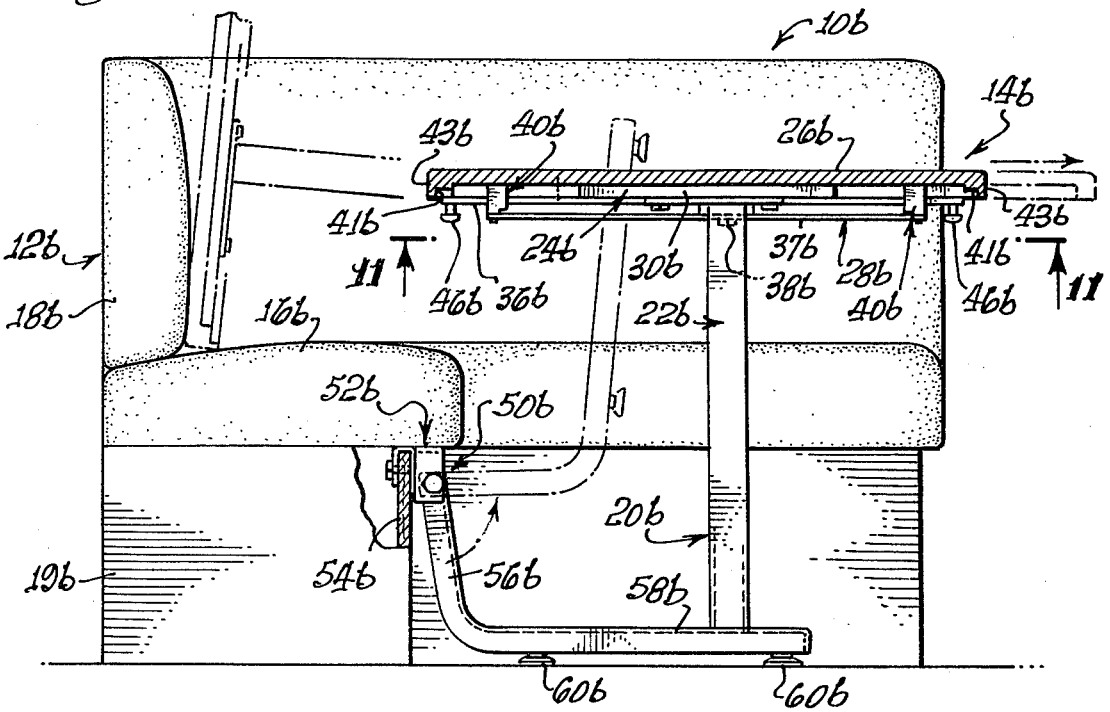
FIG. 8 is a side elevation of a dining nook embodying a further modified adjustable table according to the invention.
Figure 9:
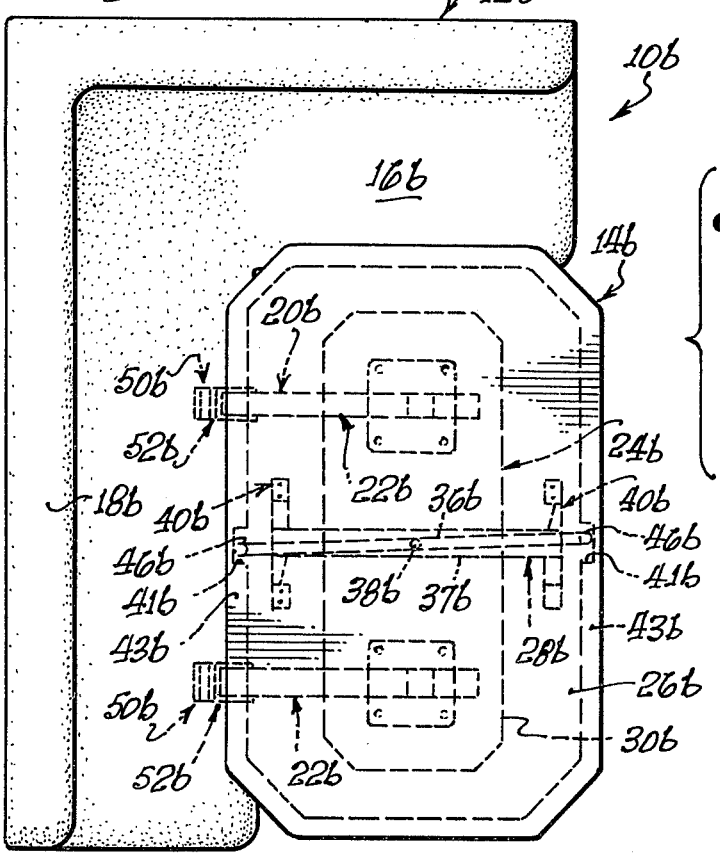
FIG. 9 is a top view of the dining nook in FIG. 8.
Figure 10:
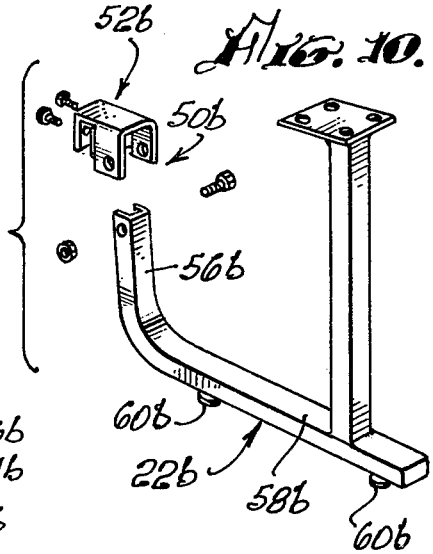
FIG. 10 is an exploded prespective view of a table support embodied in the nook of FIG. 8.

As noted earlier, the table 14*b* is hinged to the bench seat 12*b* for swinging vertically between its lower use position and raised cleaning position of FIG. 8. While this hinged mounting of the table forms no part of the present invention, it is worthwhile to consider the hinged mounting briefly as it relates to the sliding adjustment of the table top 26*b*.

Table 26*b* is attached to the bench seat base 19*b* by means of hinged connection 50*b* including hinge brackets 52*b* which are secured to the front wall 54*b* of the seat base and pivotally connected to rear upturned ends 56*b* of table base members 58*b* rigidly joined the lower ends of the table base columns 22*b*. These base members have feet or pads 60*b* which rest on the floor when the table occupies its lower use position. Hinged connection 50*b* supports the table 26*b* to swing between this lower use position and its illustrated raised cleaning position wherein the rear or left hand edge (as viewed in solid lines in FIG. 8) of the top rests in one seat cushion 16*b* of the bench seat 12*b*. When raising and lowering the table, the table top 26*b* is locked in its forward phantom line position shown in the upper right-hand portion of FIG. 8. This enables the table to occupy its broken line raised cleaning position wherein the weight of the top retains the table in the latter position.

The inventor claims:

1. A table comprising:

a supporting base including a horizontal platform, a table top overlying and slidably supported on said platform for edgewise adjustment relative to the platform, said top having larger edgewise dimensions than said platform and projecting edgewise beyond said platform, and means for firmly clamping said top against edgewise movement relative to said platform including a clamping bar extending across the underside of said platform and beyond two opposite edges of the platform, whereby said bar has opposite ends located beyond said opposite platform edges and below said top, means pivotally mounting said clamping bar on said top to swing in a plane parallel to said top and platform, and means for effecting movement of said clamping bar into and from clamping engagement with the underside of said platform in response to swinging of the member about its pivot axis.

2. A table comprising:

a supporting base including a horizontal platform, a table top overlying and slidably supported on said platform for edgewise adjustment relative to the platform, means for firmly clamping said top against edgewise movement relative to said platform including a clamping bar below said platform, means pivotally mounting said clamping bar on said top to swing in a plane parallel to said top and platform, and means for effecting movement of said clamping bar into and from clamping engagement with said platform in response to swinging of the member about its pivot axis, said clamping bar having a free end spaced from its pivot axis, and said effecting means comprising an inclined ramp on the underside of said top engaging under the free end of the clamping bar along which the bar end slides during swinging of the bar for deflecting the bar into and releasing the bar for deflection from clamping engagement with said platform.

3. A table according to claim 2 wherein:

said clamping bar extends beyond opposite edges of said platform and is pivotally mounted at one end on the underside of said top beyond one edge of said platform, and said ramp is mounted on the underside of said top beyond the opposite edge of said platform.

4. A table according to claim 2 wherein:

said clamping bar extends beyond opposite edges of said platform and is pivotally mounted at its center on the underside of said top, said ramp is mounted on the underside of said top beyond one edge of said platform, and said effecting means comprises a second ramp mounted on the underside of said top beyond the opposite edge of said platform and engages under the opposite end of said clamping bar.

5. A table according to claim 4 wherein:

said clamping bar mounting means comprises a support bar mounted on the underside of said top and extending across the underside of said platform, and means pivotally mounting said clamping bar on said support bar.

6. A table according to claim 5 wherein:

said support bar is located below said clamping bar and is attached at its ends to said ramps.

7. A table according to claim 1 including:

retaining means in addition to said clamping means for retaining said top in sliding contact with said platform.

8. A table according to claim 7 wherein:

said retaining means comprises at least one retaining bar extending across the underside of said platform and secured at its ends to the underside of said top.

9. A table according to claim 8 wherein:

said retaining means comprises a pair of said retaining bars straddling said clamp means.

* * * * *